US006592022B1

(12) United States Patent
Kamoi

(10) Patent No.: US 6,592,022 B1
(45) Date of Patent: Jul. 15, 2003

(54) MAILING ENVELOPES AND A METHOD OF MAKING SAME USING STANDARD PAPER SIZES AND A METHOD OF STUFFING SAME

(75) Inventor: Koichi Kamoi, Wako (JP)

(73) Assignee: Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 09/550,916

(22) Filed: Apr. 17, 2000

(51) Int. Cl.[7] ..... B65D 27/14

(52) U.S. Cl. ..... 229/75; 53/460; 53/461; 229/80; 493/245

(58) Field of Search ..... 229/75, 92.1, 80, 229/92.3; 53/460, 461; 493/245

(56) References Cited

U.S. PATENT DOCUMENTS

| | | | | | |
|---|---|---|---|---|---|
| 332,008 | A | * | 12/1885 | Scanlan | 229/75 |
| 442,842 | A | * | 12/1890 | West | 229/75 |
| 654,418 | A | * | 7/1900 | Simon | 229/75 |
| 779,135 | A | * | 1/1905 | Reinhold | 229/75 |
| 1,402,650 | A | * | 1/1922 | Pierce | 229/75 |
| 5,426,915 | A | * | 6/1995 | Davidov | 53/460 |
| 6,202,919 | B1 | * | 3/2001 | Hathi | 229/92.1 |

FOREIGN PATENT DOCUMENTS

| | | | | |
|---|---|---|---|---|
| FR | 2289404 | * | 11/1974 | 229/92.1 |

* cited by examiner

*Primary Examiner*—Stephen P. Garbe
(74) *Attorney, Agent, or Firm*—William C. Cray

(57) ABSTRACT

Mailing envelopes are made by using standard paper sizes with prescribed folds and application of adhesive. In one form, the envelope is of a horizontal configuration to receive a letter typical in countries like the United States of America and in another configuration, the envelope is more typical of envelopes for receiving a letter in countries like Japan.

8 Claims, 10 Drawing Sheets

MAILING ENVELOPES AND A METHOD OF MAKING SAME USING STANDARD PAPER SIZES AND A METHOD OF STUFFING SAME

BACKGROUND OF THE INVENTION

In Davidov U.S. Pat. No. 5,426,915, granted Jun. 27, 1995, there is disclosed a method of and an apparatus for forming envelopes from a standard size sheet of paper by feeding the sheet, cutting from the sheet certain marginal portions, and completing the envelope by applying adhesive to selected portions and folding the same in adherence with other portions.

Japan Patent Disclosure Heisei 9-295475 provides a letter that can be mailed as a first class standard mail without a separate envelope and its manufacturing method. This letter is made of an A4 size three-fold paper. Two overlapping sides of this three-fold paper are adhesively secured. The name and address can be written on an exposed side. A computer generated document can be printed on the same paper that contains the printed name and address, saving an extra time and work of writing the name and address separately.

SUMMARY OF THE INVENTION

The present invention relates to methods of folding letter sized sheets of, say A4 paper of the type used for printing in computer controlled printers and copiers, to form a mailing envelope in a manner avoiding the need for cutting any portions of the sheet to be folded.

Such envelopes will be capable of receiving a small number, say up to three or four sheets, depending upon the weight or thickness of the sheets of printed matter.

The foregoing methods are accomplished by folding with respect to a relatively large main, central section of the sheet, portions or flaps which are folded so as to form about the four side edges of the main section a smaller back portion, side portions and a sealing back portion of the envelope.

A number of printed pages of the same size can be folded transversely at a number of locations so that the transversely folded printed page, or pages, if more than one, can be inserted into the envelope before final envelope folding or thereafter.

Typically, in the United States of America, the envelope is pre-formed so that final closure is along a long edge at the top of the envelope, or horizontally with respect to the application of an address and stamp, but in Japan the closure flap is along one long edge, but at one side of the envelope, or vertically, with respect to the application of an address and a stamp.

When the long side of the A4 size rectangular paper is referred to as L, the short side of the rectangular paper is referred to as S, and the width of the adhesive parts on the second back side for a horizontal envelope or on the main right side for a vertical envelope is referred to as P, the original envelope making paper is larger (S-2P)/2 than L/3. It is adequate for a horizontal United States style envelope or a vertical Japanese style envelope. It is especially useful for mechanization of making stuffed envelopes with three-fold printed A4 or other regular paper sizes.

Accordingly, printing upon a sheet of plain, normal letter size paper may be applied in either of the above typical cases and the envelope sheet can be subsequently folded to form the envelope in either case.

The envelope making method makes stuffed envelopes by placing the contents of the envelope on the back of the main envelope side first, before folding. It is adequate for making original envelope papers and their contents of the same size from regular size papers such as A4 papers by using PCs or word processors for the tasks of printing an address on the envelope and a letter to be enclosed. It is useful for mechanizing the process to make stuffed envelopes.

BRIEF DESCRIPTION OF THE DRAWINGS

FIG. 1(*b*) is a view showing an alternative of the sheet shown in FIG. 1(*a*)

FIG. 2(*b*) is a view showing an alternative of the sheet shown in FIG. 1(*b*);

FIG. 3(*b*) shows the opposite face of the envelope of FIG. 3(*a*);

FIG. 3(*c*) shows on an enlarged scale the corner fold and fold lines of FIG. 3(*b*) embraced by the eliptical line 3(*c*);

FIG. 3(*d*) shows the top of the side flap folded downwardly, in full lines, from the unfolded dotted line position;

FIG. 3(*e*) shows a fully folded envelope;

FIG. 4(*b*) shows the opposite face of the envelope of FIG. 4(*a*);

FIG. 4(*c*) shows on an enlarged scale the corner fold of FIG. 4(*b*) embraced by eliptical line 4(*c*); and FIG. 4(*d*) shows a fully folded envelope.

DESCRIPTION OF THE PREFERRED EMBODIMENT

Figure 1:
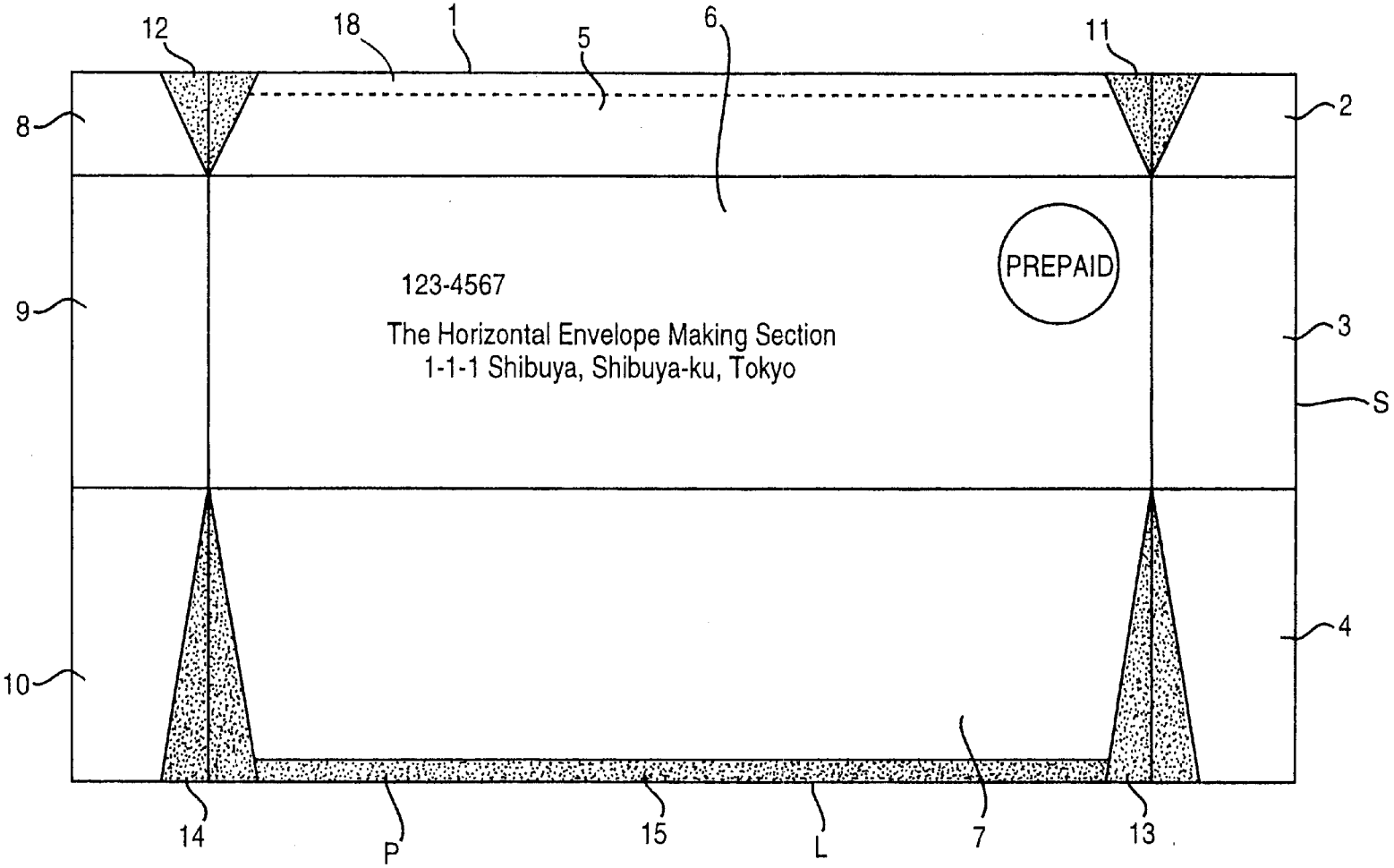
FIG. 1(*a*) is a view showing the fold lines and areas of adhesive application to a standard letter size sheet foldable on fold lines, by the method hereof in the case of a sheet useful in the United States of America, and elsewhere in the Western world.
Figure 1A:
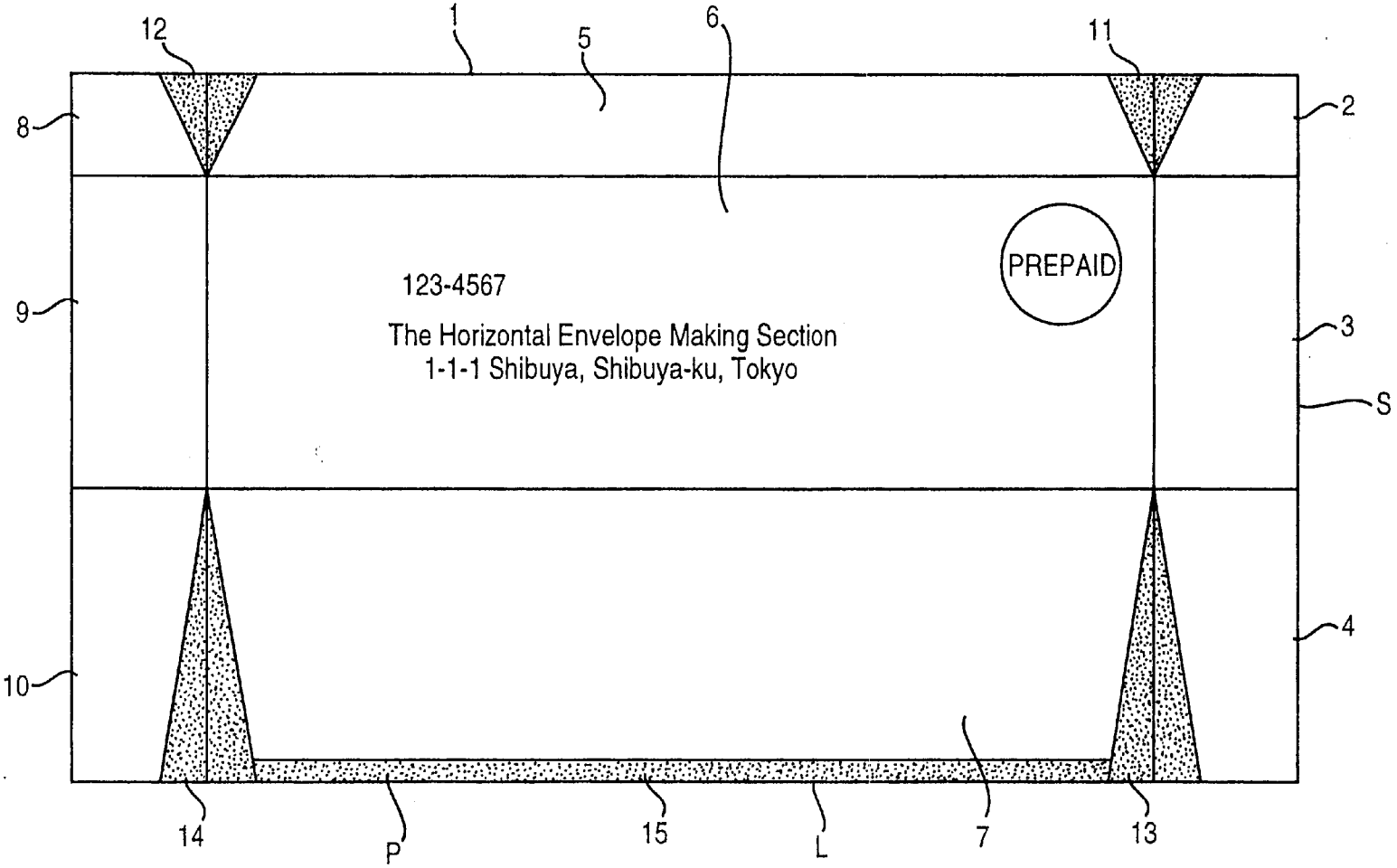
Figure 1B:
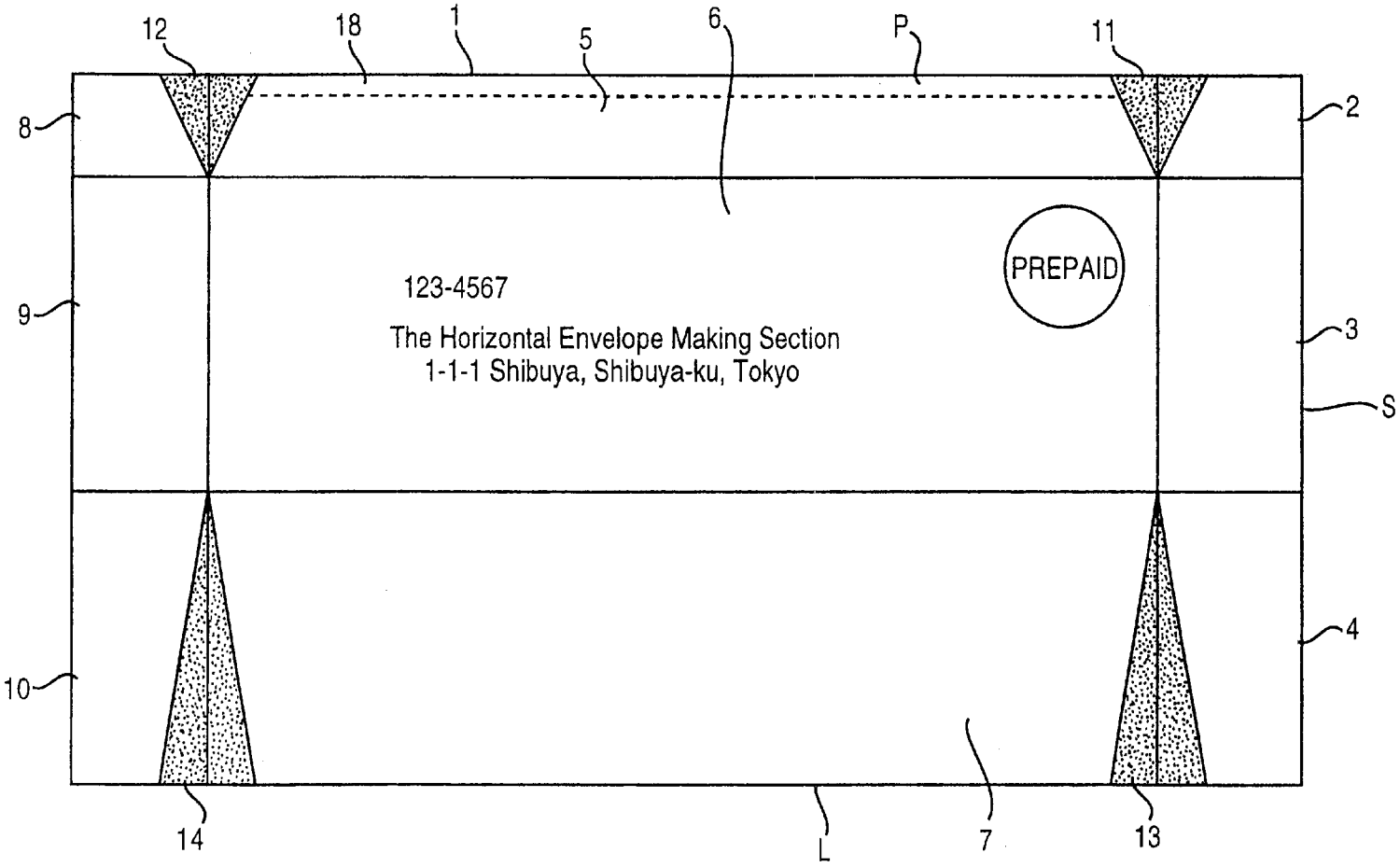

FIG. 1 shows the horizontal envelope making paper 1 of this invention that is used for making Western style envelopes such as used commonly in the United States. The sheet of A4 size paper may be marked to form a rectangular main envelope section 6, a first narrow back section 5 above section 6, a second back side 7 below section 6, a center right side 3, and a center left side 9. The sheet has a first right side 2 to the right of first back side and above the center right side, a left side 8 on the left and above the outer left side 9, a second right side 4 on the right of the second back side 7 and below the center right side 3, and a second left side 10 on the left of the second back side 7 and below the center left side 9. The size of the main envelope section 6 is 230 mm×99 mm and the name and address will be written on this side of the finished envelope. The maximum size allowed for first class standard mail is 120 mm×235 mm. The minimum size allowed for the first class standard mail is 90 mm×140 mm. It is desirable to set the size of the main envelope section 6 within these measurements.

Triangular adhesive parts 11, 12, 13, and 14 are respectively placed between the first narrow back side 5 and the first right side portion 2, between the first narrow back side 5 and the left side portion 8, between the second back side 7 and the second right side portion 4, and between the second back side 7 and the second left side portion 10. There is, also, a rectangular adhesive section 15 at this portion of the outer edge of the surface of the second back side 7. These adhesive parts can be secured by applying adhesive material only on the necessary parts as shown by the fold lines. An adhesive material such as a heat and pressure responsive adhesive sheet can be applied before heating or applying pressure on necessary parts.

Since the main envelope section 6 is where the name and address are printed or written, the triangular adhesive parts 11, 12, 13, and 14, and the rectangular adhesive part 15 are placed on the same side of the envelope making sheet, the back side of the paper remains clear. This will improve the operability of envelope making and is useful for mechanization of the envelope folding.

The triangular adhesive parts 11, 12, 13, and 14 on the original horizontal envelope making paper shown in FIG. 1 can also be made square, partially overlapping the respective adjacent portions of the sheet. By using square adhesive parts, a more sufficient width of the adhesive parts can be obtained and the operability of envelope making will be improved. This also provides a technological effect of making stronger envelopes due to the increased size of the adhesive parts.

The original horizontal envelope making paper with a rectangular adhesive application 18, indicated by the broken line 18 on one part of the exterior edge of the back of the first back side 5 can be used instead of the adhesive part 15, as shown. In this case, since the original horizontal envelope making paper has the adhesive part 18 on the back of the first back side 5, the technological feature of having all adhesive parts and printed side on the same side will be lost, but a technological advantage of easily setting the positions of adhesive parts during envelope making envelope will be gained.

When the long side of the A4 size original horizontal envelope making paper 1 is referred to as L, the short side is referred to as S, and the width of the adhesive part 15 of the second back side 7 is referred to as P, the Western style envelope that can contain three-fold A4 size papers by setting (S-2P)/2 larger than L/3. In this case, the same A4 size paper can be used to make a Western style envelope and its contents. The address and the contents of the letter can be made at the same time by using PCs or word processors that are generally used in offices. A Western style envelope and its contents do not have to be prepared separately. Therefore, this invention significantly reduces the cost of making a large volume of stuffed mailing such as direct mail.

FIG. 1 explains the A4 size original horizontal envelope making paper that is useful for a Western style envelope. The size of the paper is not limited to A4 size, and letter size (216 mm×279 mm) and executive size (191 mm×267 mm) can also be used. These letter size or executive size papers can be used to make Western style envelopes within the size allowed for the first class standard mail by having the rectangular main envelope side on such letter size or executive size paper. A Western style envelope that can contain, say, three-fold letter size or executive size paper can be made by having larger (S-2P)/2 than L/3 when the long side of the original horizontal envelope making sheet is referred to as L, the short side is referred to as S, and the width of the adhesive part 15 of the second back side 7 is referred to as P. Furthermore, the size of the paper is not limited to A4 size letter size, or executive size. Other sizes that are proper for the purposes of the letters can also be used.

Figure 2:
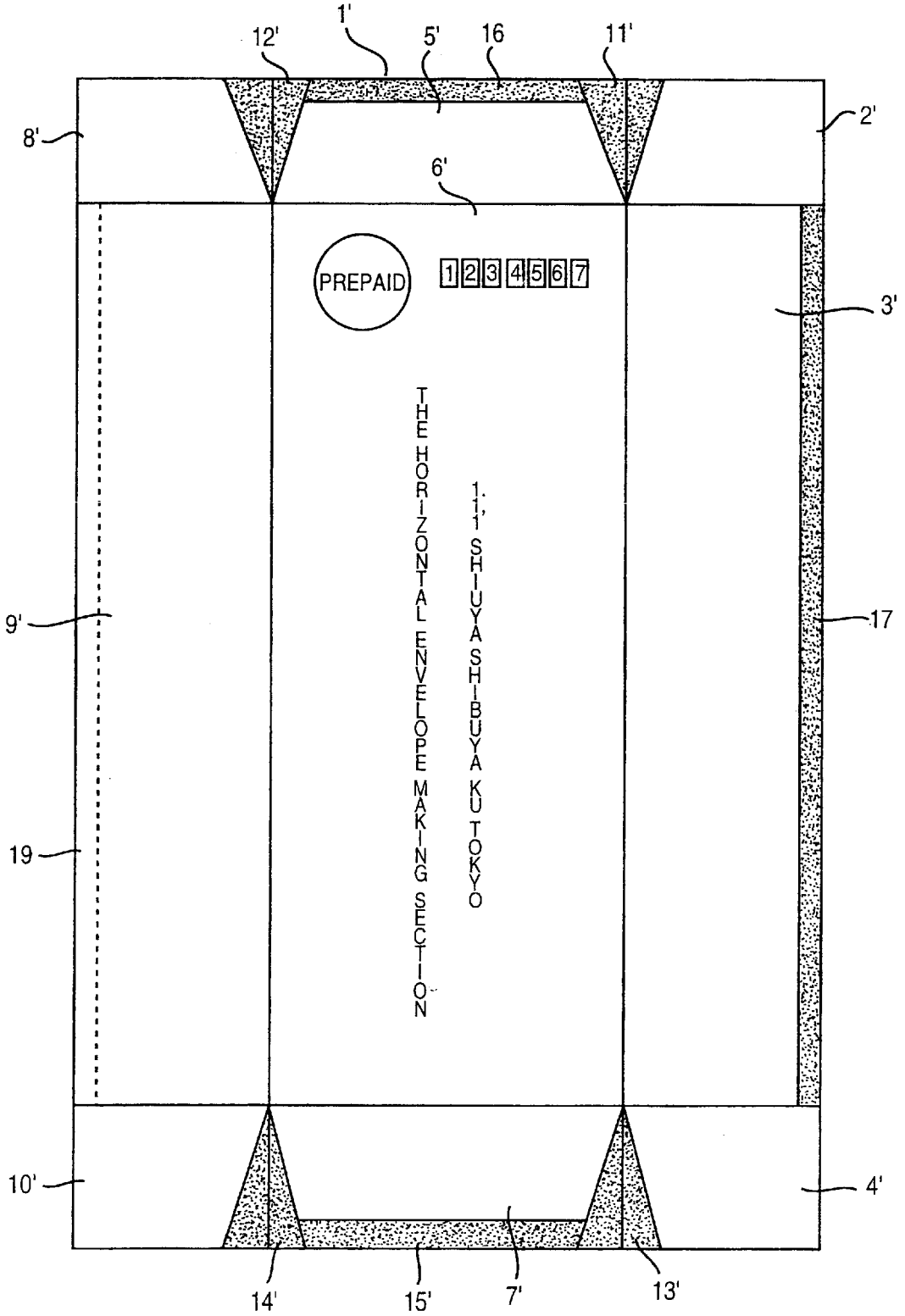
FIG. 2(*a*) is a view like FIG. 1, but showing the fold lines and areas of adhesive application to a standard letter size sheet foldable by the method hereof in the case of a sheet useful in Japan, and elsewhere in the Eastern world.
Figure 2A:
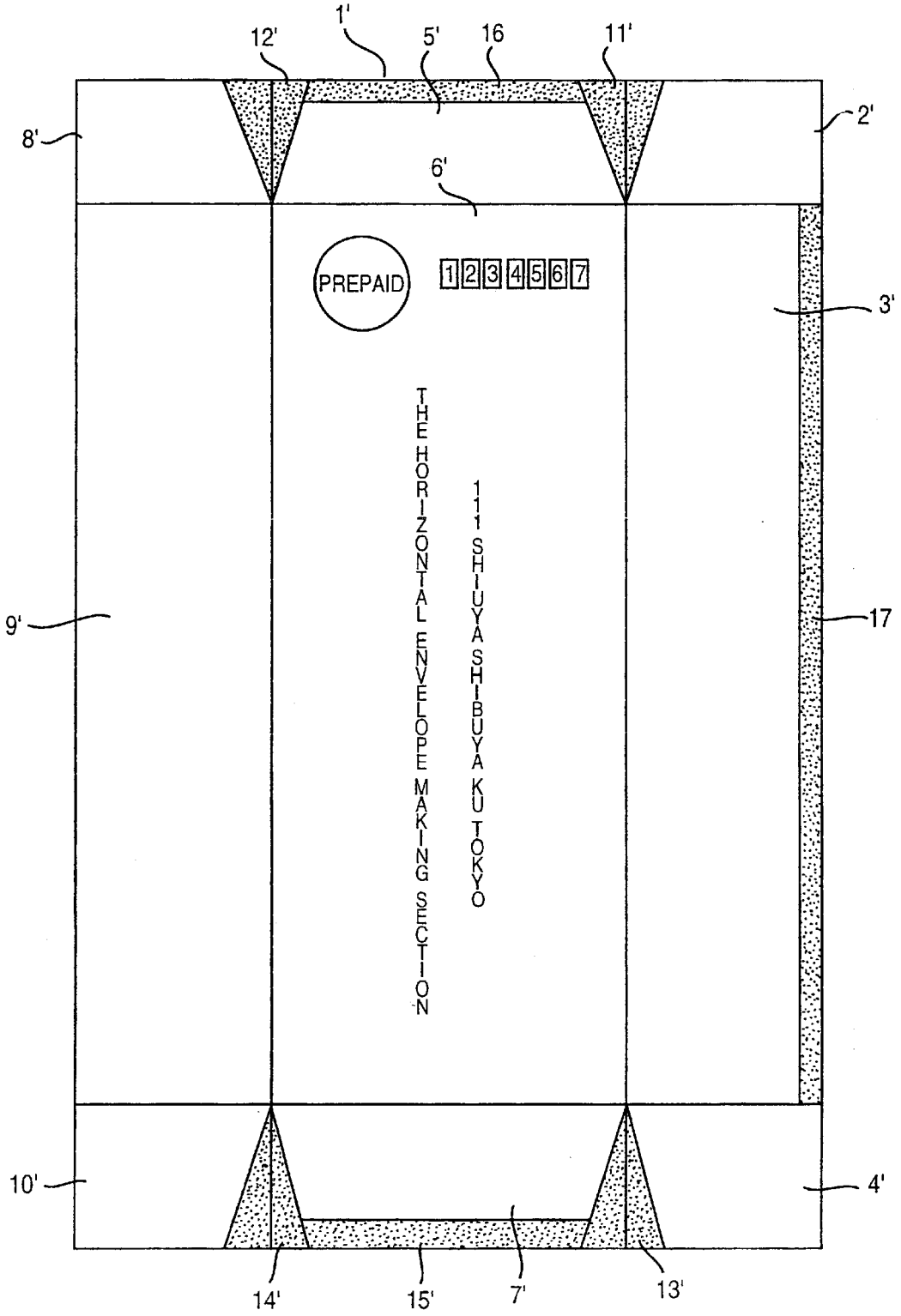
Figure 2B:
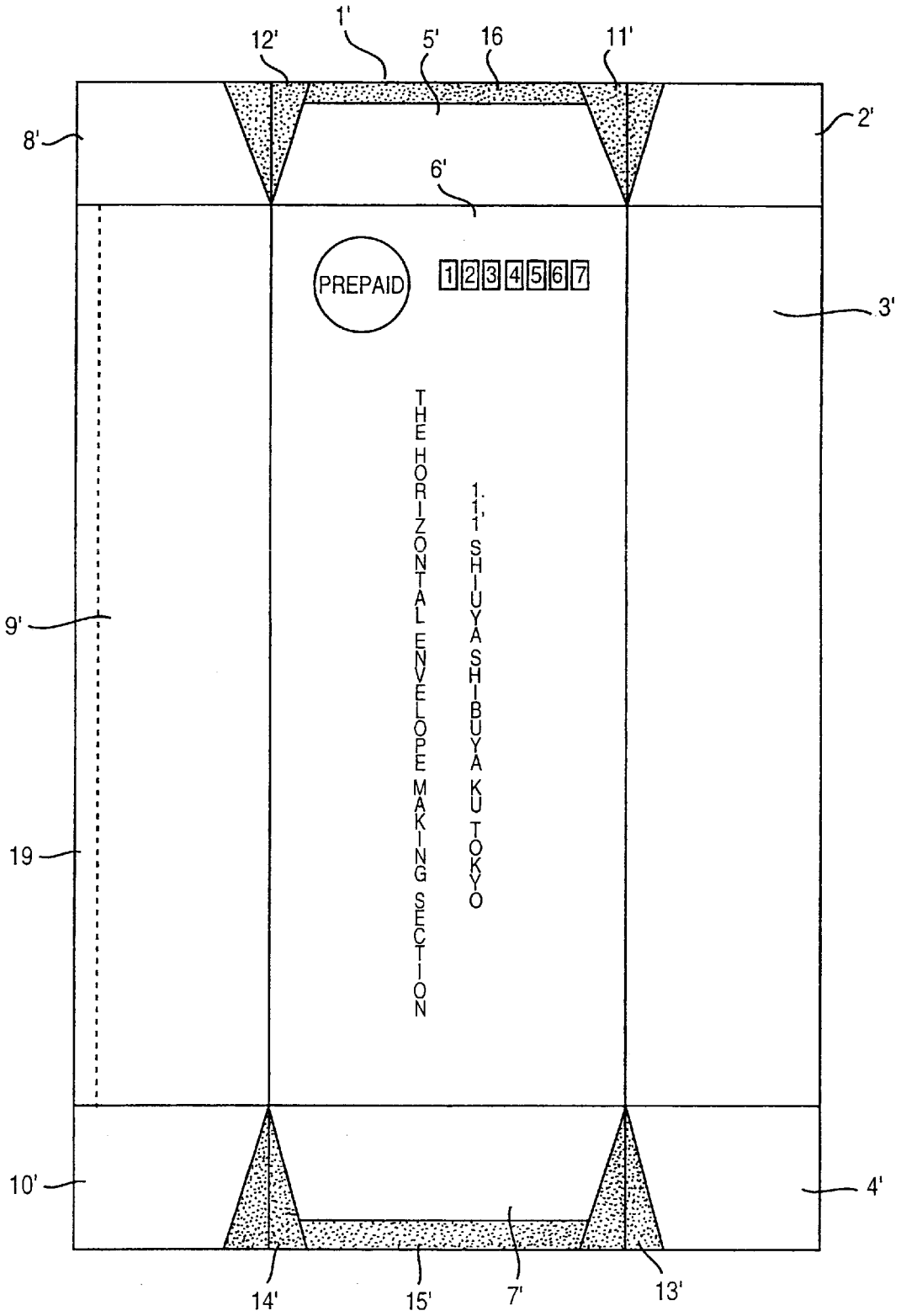
Figure 3A:
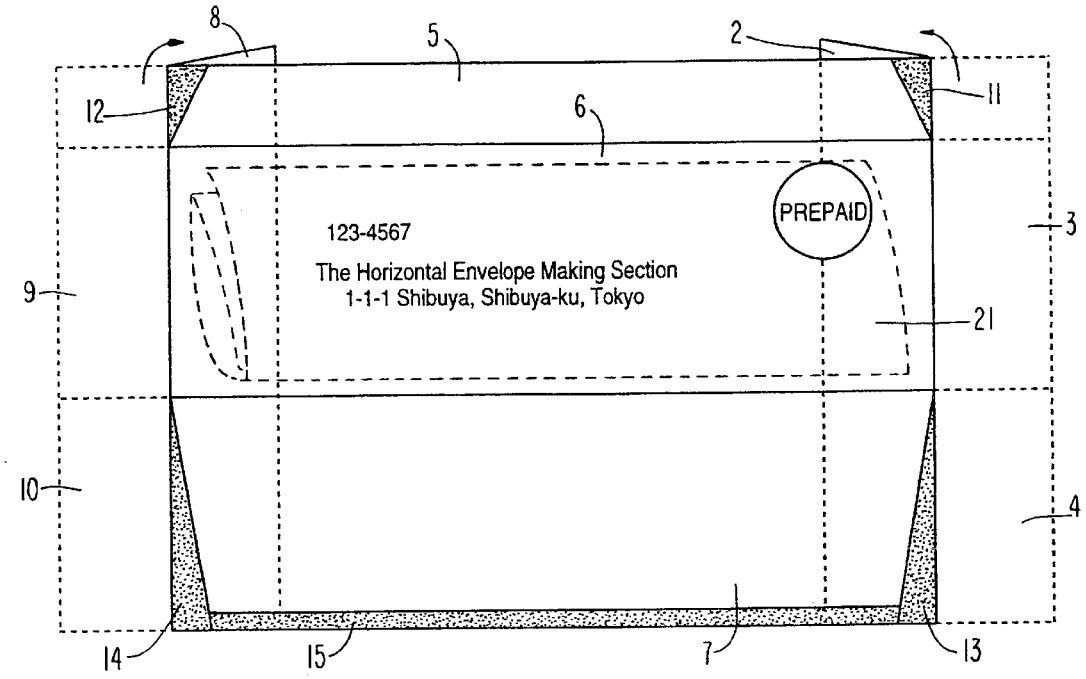
FIG. 3(*a*) is a view showing the first steps in folding the sheet of FIG. 1, and showing, in broken lines, the ability of the envelope, when fully folded, to contain a letter made from the same standard sheet size as the envelope.
Figure 3B:
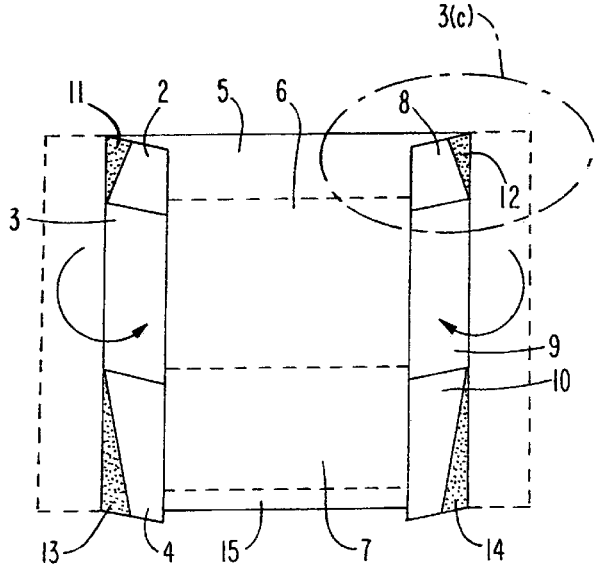
Figure 3C:
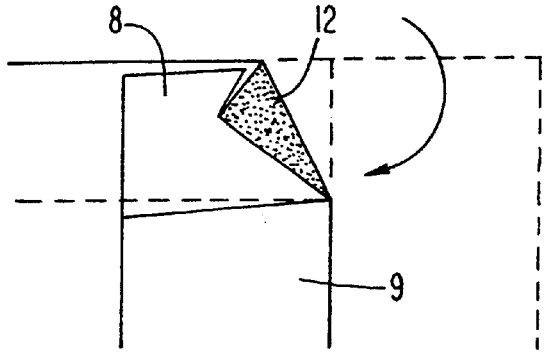
Figure 3D:
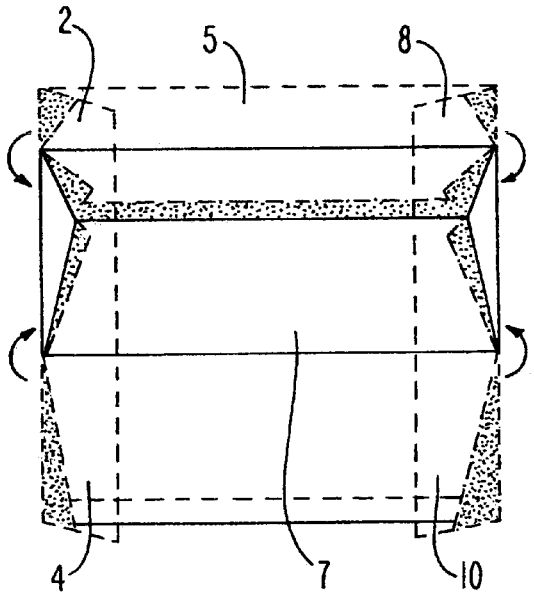
Figure 3E:
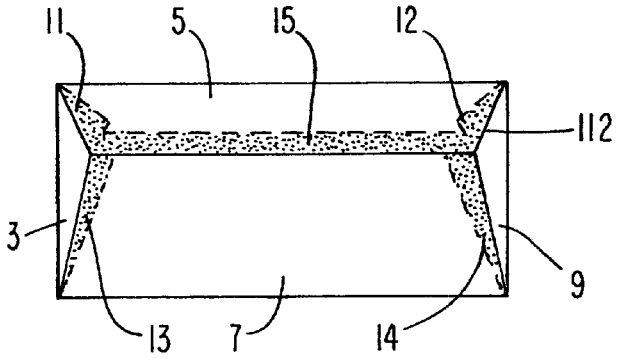
Figure 4A:
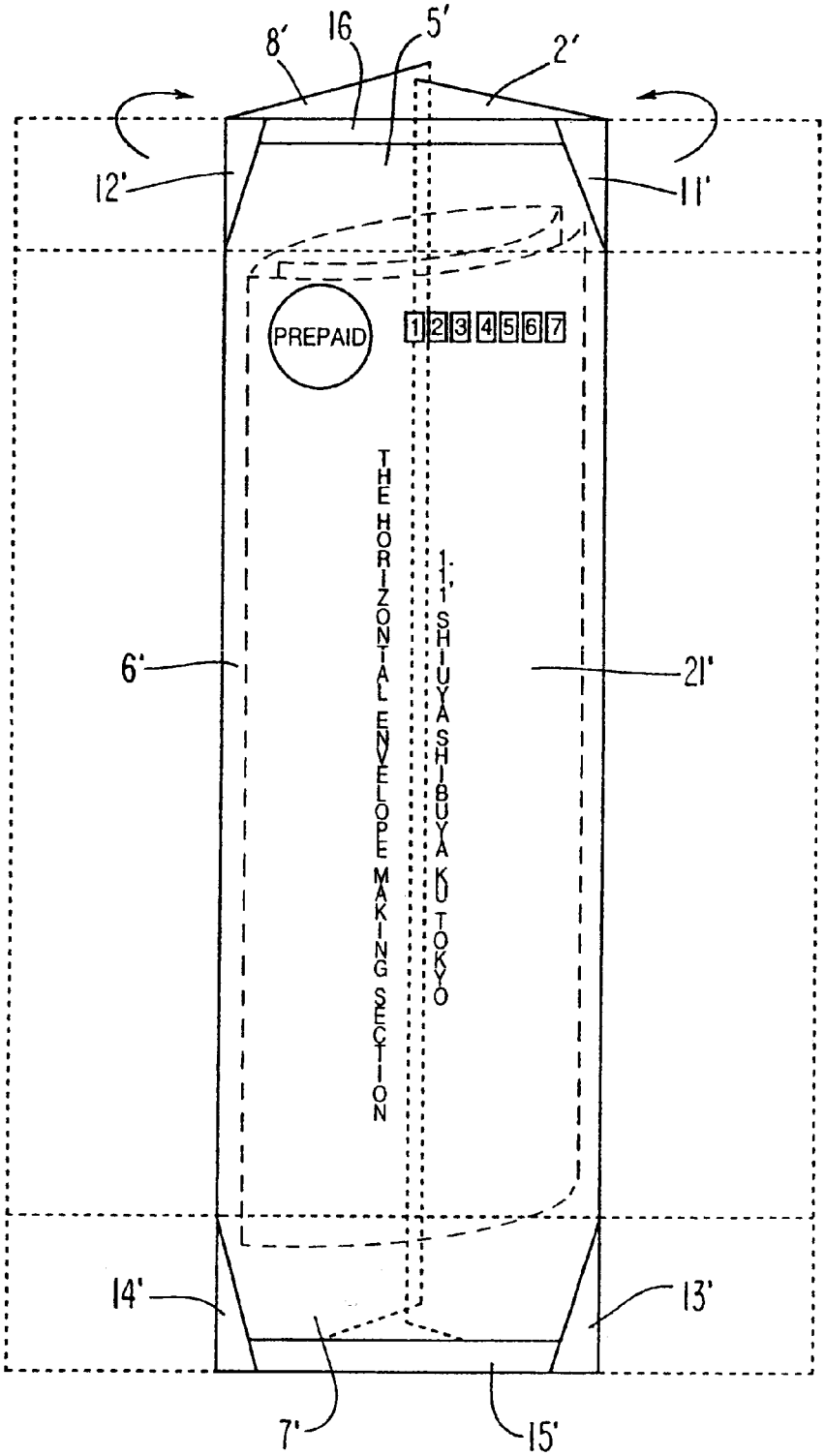
FIG. 4(*a*) is a view showing the first steps in folding the sheet of FIG. 2, and showing, in broken lines, the ability of the envelope, when fully folded, on the fold lines to contain a letter made from the same standard sheet size as the envelope.
Figure 4D:
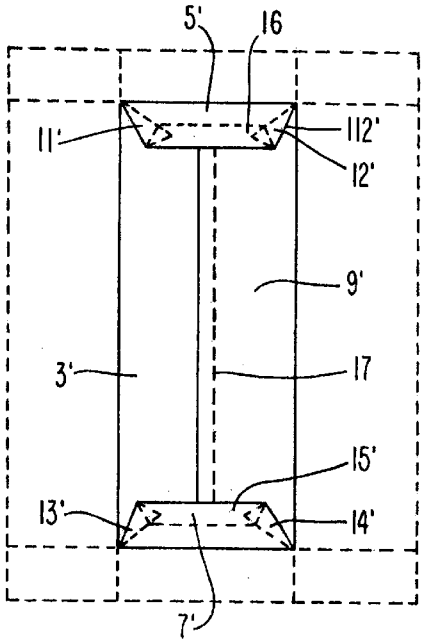
Figure 4C:
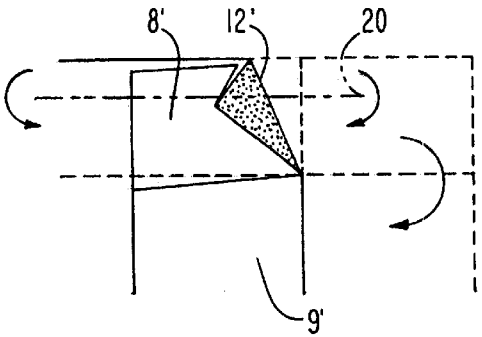
Figure 4B:
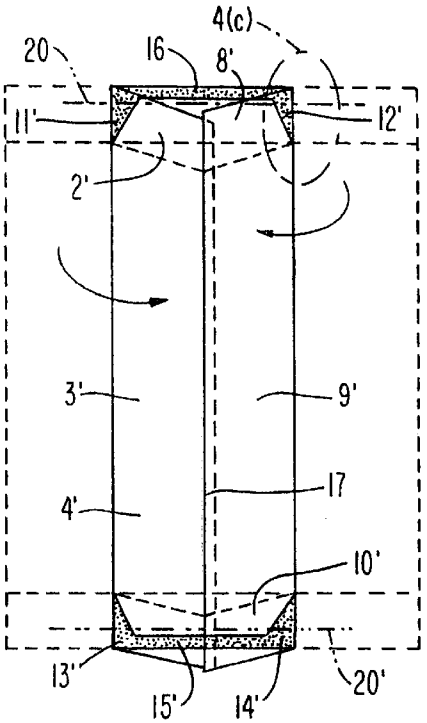

FIG. 2 shows the A4 size original vertical envelope making paper 1' of this invention that is adequate for a Japanese or other Eastern style envelope. Each corresponding part to the original horizontal envelope making paper shown in FIG. 1 is indicated by adding (') to the same reference number. Differences between FIGS. 1 and 2 are that the original rectangular paper is horizontal in the FIG. 1, but it is vertical in FIG. 2, and that FIG. 2 shows rectangular adhesive parts 16 and 17 on the exterior edge of the surface of the first back side 5' and the main right side 3' respectively. The size of the main envelope section 6' in the FIG. 2 is 235 mm×99 mm, which is within the size allowed for first class standard mail.

The original vertical envelope making paper 1' of this invention that is useful for a Japanese style envelope shown in FIG. 2 also has the main envelope section 6' and each adhesive part on the same surface of the A4 size paper like the Western style envelope shown in FIG. 1. Since conditions of the back of the paper does not affect envelope making, the operability of envelope making will improve and it is also useful for mechanization of envelope making.

The triangular adhesive parts 11', 12', 13', and 14' on the original vertical envelope making paper 1' shown in FIG. 2 can also be square, partially overlapping the first right side 2', the first left side 8', the second right side 4', and the second left side 10'. The more sufficient width of the adhesive parts can be obtained like the Western style envelope shown in FIG. 1. The operability of adhesion will be improved an technological effect of making stronger envelopes can be obtained due to the increased size of the adhesive parts.

The original vertical envelope making paper with a rectangular adhesive part 19 on one part of the exterior edge of the back of the main left side 9' can be used in place of the adhesive part 17 shown in FIG. 2. In this case, since the original vertical envelope making paper has the adhesive part 19 on the back of the main left side 9', the technological feature of having all adhesive parts and printed side on the same surface is lost. However, it gains a technological advantage of easily setting the positions of the adhesive parts during envelope making like the Western style envelope shown in FIG. 1.

When the long side of the A4 size original vertical envelope making paper 1' is referred to as L, the short side is referred to as S, and the width of the adhesive part 17 of the main right side 3' is referred to as P, the Japanese style envelope that can contain three-fold A4 size papers can be made by having (S-2P)/2 larger than L/3. A Japanese style envelope and its contents can be made from the same A4 size paper like the Western style paper. Since the address and the contents of the letter can be made at the same time by using PCs or word processors that are generally used in offices, the Japanese style envelope and its contents do not need to be prepared separately. Therefore, this invention significantly reduces the cost of making a large volume of mails such as direct mails.

FIG. 2 explains the A4 size original vertical envelope making paper that is adequate for Japanese style envelope. Like the Western style envelope, the size of the paper is not limited to A4 size and other sizes such as letter size or executive size can also be used. A Japanese style envelope within the size allowed for first class standard mail can be made by having the rectangular main envelope side on this letter size or executive size paper. When the long side of the original vertical envelope making paper 1' is referred to as L, the short side is referred to as S, and the width of the adhesive part 17 of the main right side 3' is referred to as P, a Japanese style envelope that can contain three-fold letter size or executive size papers by having larger (S-2P)/2 than L/3. Furthermore, the size of the paper is not limited to A4 size, letter size, or executive size. Other sizes that are adequate for the purpose of the letter can be used.

The method to make horizontal envelopes that are useful for the Western style envelopes of this invention is described based on FIGS. 3(*a*) to 3(*e*).

First of all, as shown in FIGS. 3(*a*) and 3(*b*), place the contents of the envelope 21, for example, the three-fold A4 size printed matter, on the back side of the main envelope section 6, and then fold back the first right side 2, the main right side 3, the second right side 4, the first left side 8, the main left side 9, and the second left side 10. Then, as shown in FIGS. 3(*b*) and 3(*c*), fold back triangular adhesive parts, 11, 12, 13, and 14. Then, as shown in FIG. 3(*d*), fold back the second right side 4, the second back side 7, the second left side 10, the first right side 2, the first back side 5, and the first left side 8. Finally, adhere the necessary parts by heating or applying pressure on the heat or pressure adhesive sheets placed on the adhesive parts 11, 12, 13, 14, and 15. This will complete the Western style envelope with its contents. Instead of securing the necessary adhesive parts by heating or applying pressure on adhesive materials such as heat pressure adhesive sheets in the final process, the adhesive parts can be secured after folding the adhesive parts and securing them when folding each adhesive part as shown in FIGS. 3(*c*) and 3(*d*).

In the process shown in FIG. 3(*a*) through 3(*d*), cutting out parts or incision of parts are not required for the envelope making paper. Envelopes are made by the processes of folding and adhesively securing the envelope making papers. It is useful for the mechanization envelope making.

Instead of cutting out panels or incision of parts, as will be recognized by reference to FIGS. 3(*b*) and 3(*c*), showing the folding process and by reference to FIG. 3(*e*) showing the finished envelope, the respective adhesive portions 11, 12, 13 and 14 (as seen in FIG. 1) are formed as triangles, each having a base at the outer edge of the juncture of the back portions 5 and 7 and extending along a central fold line to the long fold line for the back sides 5 and 7. Referring more specifically to FIGS. 3(*b*) and 3(*c*), it will be seen that the central fold line of each triangle is folded inwardly so that the triangle is adapted to form an angular edge 112 on the finished envelope which, preferably, merge together at the back of the envelope, as seen in FIG. 3(*e*).

When the long side of the A4 size original horizontal envelope making paper that is adequate for the Western style envelopes is referred to as L, the short side is referred to as S, and the width of the adhesive part 15 of the second back side 7 is referred to as P, the Western style envelope that can contain three-fold A4 size papers can be made by having larger (S-2P)/2 than L/3. The size of the paper is not limited to A4 size. Other sizes such as letter size or executive size can also be used.

The method of making vertical envelopes that are useful for Japanese style envelopes of this invention is described based on FIGS. 4(*a*) to 4(*e*). First of all, as shown in FIGS. 4(*a*) and 4(*b*), place the contents of the envelope 21', for example, the three-fold A4 size printed matter, on the back side of the main envelope section 6' and fold back the first right side 2', the main right side 3', the second right side 4', the first left side 8', the main left side 9', and the second left side 10'. Then, as shown in FIGS. 4(*b*) and 4(*c*), fold back the triangular adhesive parts 11', 12', 13', and 14'. Then, as shown in FIGS. 4(*b*) and 4(*c*), fold the second right side 4', the second back side 7', and the second left side 10' along the folding line 20', and fold back these folded parts along the inside border line of the second back side 7'. Likewise, fold back the first right side 2', the first back side 5', and the first left side 8' along the folding line 20, and fold back these folded parts along the inside border line of the first back side 5'. Finally, adhere the necessary parts by heating or applying pressure on the adhesive material such as the heat pressure adhesive sheets placed on the adhesive parts 11', 12', 13', 14', 15', 16, and 17, and complete the Japanese style stuffed envelope.

Instead of adhering the necessary parts by heating or applying pressure on the adhesive material such as the heat pressure adhesive sheets in the final procedure, you can fold these adhesive parts first and then secure them while folding the adhesive parts as shown in FIGS. 4(*c*) and 4(*d*).

In the process shown in FIG. 4, cutting out parts or incision of parts are not required for the envelope making papers. Envelopes are made by the procedures of folding and adhesively securing the envelope making papers. It is useful for the mechanization of envelope making.

Instead of cutting out panels or incision of parts, as will be recognized by reference to FIGS. 3(*b*) and 3(*c*), showing the folding process and by reference to FIGS. 3(*e*) showing the finished envelope, the respective adhesive portions 11, 12, 13 and 14 as seen in FIG. 1 are formed as triangles each having a base at the outer edge of the juncture of the back portions 1 and 7 and extending along a central fold line to the long fold line for the back sides 1 and 7. Referring more specifically to FIGS. 3(*b*) and 3(*c*), it will be seen that the central fold line of each triangle is folded inwardly so that the triangle is adapted to form an angular edge on the finished envelope which, preferably, merge together at the back of the envelope.

Like the Western style envelope, when the long side of the A4 size vertical envelope making paper for the Japanese style envelope is referred to as L, the short side is referred to as S, and the width of the adhesive part 17 of the main right side 3' is referred to as P, the Japanese style envelope that can contain three-fold A4 size papers can be made by having (S-2P)/2 larger than L/3. The size of the paper is not limited to A4 size. Letter size or executive size papers can also be used.

In these envelope making methods, the procedures to fold and adhesively securing folded papers are used to make envelopes from either the original horizontal envelope making papers or the original vertical envelope making papers. Cutting out parts and incision of parts are not required for the envelope making papers. Therefore, these procedures can eliminate the disposal procedure of cut papers and the paper cutting procedure. Envelopes can be made from the printed letters created by PCs or word processors.

What is claimed is:

1. An envelope making rectangular sheet of paper having a surface (1) comprising:

a rectangular main envelope section (6), a first narrow back side (5) along one long side, a second back side (7) along the other long side, a main right side (3) on the short right side, a main left side (9), on the short left side, a first right side (2) on the right of the first back side (5), a first left side (8) on the left of the first back side (5), a second right side on the right of the second back side (7), and a second left side (10) on the left of the second back side (7), adhesive parts (11, 12, 13, and 14) at the junctions between the first back side (5) and the first right side (2), between the first back side (5) and the first left side (8), between the second back side (7) and the second right side (4), and between the second back side (7) and the second left side (10), and an elongated adhesive strip (15) or (18) on the outer edge of the surface of one of the back sides (5) or (7).

2. An envelope making rectangular sheet of paper having a surface and a short top end, a short bottom end, and a pair of long sides (1') comprising:

a rectangular main envelope section (6'), a first narrow main back side (3') along one long side, a second narrow main back side (9') along the other long side, a main top side (5') on the short top end, a main bottom end (7'), on the short bottom end, a first right side (2') on the right of the first top end (5'), a first left side (8') on the left of the top end (5'), a second right side (4') on the right of the bottom end (7'), and a second left side (10') on the left of the bottom end (7'), adhesive parts (11', 12', 13', and 14') at the junctions between the top end (5') and the first right side (2'), between the top end (5') and the first left side (8'), between the bottom end (7') and the second right side (4'), and between the bottom end (7') and the second left side (10'), and an elongated adhesive strip (15' and 16) on the outer edge of the surface of the bottom end (7') and on the outer edge of the surface of the top end (5'), and an elongated adhesive strip (17) or (19) on the outer edge of the surface of only the first narrow main back side (3') or the second narrow main back side (9').

3. The envelope making paper of claim 1 wherein the paper is rectangular paper of A4 size.

4. The envelope making paper of claim 2, wherein the paper is rectangular paper of A4 size.

5. The envelope making paper of claim 3, for making a horizontal envelope, wherein when the long side of the rectangular paper is referred to as L, the short side is referred to as S, and the width of the adhesive strip (15) or (16) one of the second back sides (5) or (7) is referred to as P, (S-2P)/2 is bigger than L/3.

6. The envelope making paper of claim 4 for making a vertical envelope, wherein the long side of the rectangular paper is referred to as L, the short side is referred to as S, and the width of the adhesive part (17) or (19) of one of the main right sides (3') or (9') is referred to as P, (S-2P)/2 is bigger than L/3.

7. The method of making envelopes by folding flat sheets of standard size paper, said paper having:

a rectangular main section 6 or 6' bordered by first and second long back sides (5, 7) or (3', 9') of a collective size greater than the size of the main section 6 or 6', by first and second end parts (3, 9) or (5', 7') at opposite ends of said main section 6 or 6', and first additional sides (2 and 8) or (2', 8') at junctions between said back sides (5, 7) or (3', 9') and said first and second end parts (3, 9) or (5', 7') to which junctions adhesive is applied and to one of which long back sides (5, 7) or (3', 9') adhesive material is applied along an outer edge (15 or 18) or (17 or 19); the steps of:

a) folding the first right long back sides (5, 7) or (3', 9') into overlapping relation with said main section 6 or 6', b) folding said end parts (3, 9) or (5', 7') in overlapping relation to said main section 6 or 6', and c) adhesively securing the adhesive junctions and said long back sides (5, 7) or (3', 9') together.

8. The method as defined in claim 7, including placing the contents of the envelope on the back of the main section prior to performing said folding.

* * * * *